United States Patent [19]

Akiyama et al.

[11] Patent Number: 4,964,386

[45] Date of Patent: Oct. 23, 1990

[54] IDLING ROTATIONAL SPEED CONTROL SYSTEM FOR INTERNAL COMBUSTION ENGINES AFTER CRANKING

[75] Inventors: Eitetsu Akiyama; Katsuhiko Suzuki, both of Wako, Japan

[73] Assignee: Honda Motor Co., Ltd., Tokyo, Japan

[21] Appl. No.: 419,607

[22] Filed: Oct. 6, 1989

[30] Foreign Application Priority Data

Oct. 12, 1988 [JP] Japan ..... 63-256468

[51] Int. Cl.[5] ..... F02D 41/08

[52] U.S. Cl. ..... 123/339; 123/179 L

[58] Field of Search ..... 123/179 L, 339, 491

[56] References Cited

U.S. PATENT DOCUMENTS 4,702,210 10/1987 Yasuoka et al. ..... 123/339
4,829,960 5/1989 Yuzawa et al. ..... 123/339
4,903,657 2/1990 Miyazaki et al. ..... 123/339

*Primary Examiner*—Tony M. Argenbright
*Attorney, Agent, or Firm*—Arthur L. Lessler

[57] ABSTRACT

A system for controlling the idling rotational speed of an internal combustion engine controls a control valve for adjusting the opening area of an intake air passage bypassing a throttle valve after cranking of the engine, by the use of control terms including a differential term which is based on a variation in the engine rotational speed and is set and held at zero before a predetermined time period elapses after completion of cranking of the engine.

8 Claims, 6 Drawing Sheets

IDLING ROTATIONAL SPEED CONTROL SYSTEM FOR INTERNAL COMBUSTION ENGINES AFTER CRANKING

BACKGROUND OF THE INVENTION

This invention relates to an idling rotational speed control system for controlling the idling rotational speed of an internal combustion engine after cranking, and more particularly to a system of this kind which is intended to improve the stability of the engine rotational speed when the engine is at idle after cranking.

A system for controlling the idling rotational speed of an internal combustion engine has already been proposed by the assignee of the present invention in Japanese Provisional Patent Publication (Kokai) No. 62-3147, which controls a control valve for adjusting the opening area of an intake air passage bypassing a throttle valve after cranking of the engine, by the use of a feedback control gain which is set to different values depending upon whether or not a predetermined time period has elapsed after the cranking.

The proposed system is able to carry out more suitable engine rotational speed control than conventional ones. However, the proposed system still has room for improvement in the stability of the engine rotational speed when the engine is in the transitional state from cranking to after-cranking, as follows:

When the engine is brought into the aforesaid transitional state, the engine rotational speed abnormally increases, as shown by the broken line in FIG. 5, and consequently a drop occurs in the control amount for the control valve, as shown by the broken line in FIG. 6. Therefore, the proposed system still suffers from instability in the engine rotational speed at an early stage of the idling rotational speed feedback control after completion of cranking. Particularly in the case where the desired idling rotational speed is set at a higher value to promote the rise in the engine rotational speed immediately upon transition from cranking to after-cranking, the aforesaid abnormal increase in the engine rotational speed becomes even greater, which results in marked instability (fluctuation) in the engine rotational speed. Therefore, it has been difficult to secure stability of the engine rotational speed at the early stage of the idling rotational speed feedback control after completion of cranking.

SUMMARY OF THE INVENTION

It is the object of the invention to provide an idling rotational Speed control system for an internal combustion engine, which is capable of preventing fluctuation of the engine rotational speed at an early stage of the idling rotational speed feedback control after completion of cranking to thereby improve stability in the engine rotational speed.

To attain the object, the present invention provides a system for controlling an idling rotational speed of an internal combustion engine having an intake air passage, and a throttle value provided in the intake air passage.

the system including a bypass air passage bypassing the throttle valve, a control valve for adjusting opening area of the bypass air passage, valve driving means for driving the control valve, and control means for supplying a control signal to the valve driving means, the control means including engine rotational speed detecting means for detecting a rotational speed of the engine, after-start determining means for determining whether or not a first predetermined time period has elapsed after completion of cranking of the engine, desired engine rotational speed setting means for setting a desired idling rotational speed of the engine, difference determining means for determining a difference between the engine rotational speed detected by the engine rotational speed detecting means and the desired idling engine rotational speed set by the desired engine rotational speed setting means, engine rotational speed variation detecting means for detecting a variation in the detected engine rotational speed, control amount determining means for determining a value of the control signal by the use of at least one control term based on the determined difference and a differential term based on the detected engine rotational speed variation, control gain determining means for determining control gains of the at least one control term and the differential term in response to the result of determination by the after-start determining means.

The system is characterized by comprising differential term changing means for setting and holding the differential term at zero before a second predetermined time period elapses after completion of cranking of the engine when the after-start determining means has detected that the first predetermined time period has not elapsed yet after completion of cranking of the engine.

Preferably, the second predetermined time period is shorter than the first predetermined time period.

Alternatively, the second predetermined time period is equal to the first predetermined time period.

Preferably, the second predetermined time period corresponds to a time period after completion of cranking of the engine during which the variation in the engine rotational speed is great.

More preferably, the second predetermined time period is a time period during which a predetermined number of pulses are generated, each of the pulses being generated whenever the engine rotates through a predetermined angle after completion of cranking of the engine.

Preferably, the desired engine rotational speed setting means sets the desired idling engine rotational speed to a higher predetermined value before the first predetermined time period elapses after completion of cranking of the engine, whereas the desired engine rotational speed setting means sets the desired idling engine rotational speed to a lower predetermined value after the first predetermined time period has elapsed.

Further preferably, the control gain determining means sets the at least one control term and the differential term to values enabling to obtain greater control gains in order to attain the desired idling engine rotational speed set to the higher predetermined value before the first predetermined time period elapses after completion of cranking of the engine, whereas the control gain determining means sets the at least one control term and the differential term to values enabling to obtain smaller control gains in order to attain the desired idling engine rotational speed set to the lower predetermined value after the first predetermined time period has elapsed after completion of cranking of the engine.

Preferably, the at least one control term comprises a proportional term, and an integral term.

The above and other objects, features, and advantages of the present invention will become more apparent from the ensuing detailed description taken in conjunction with the accompanying drawings.

DETAILED DESCRIPTION

The invention will be described in detail with reference to the drawings showing an embodiment thereof.

Figure 1:
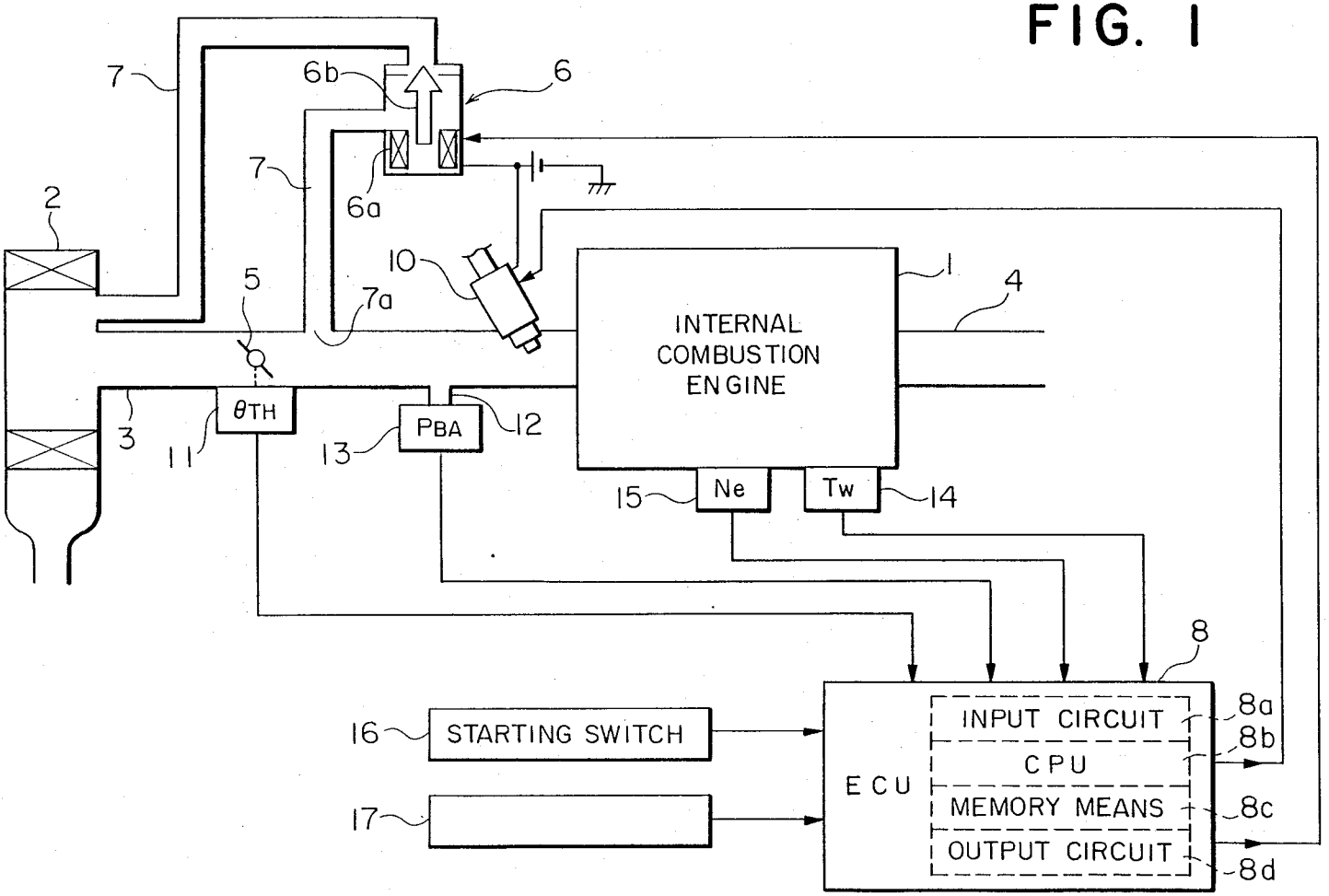
FIG. 1 is a schematic diagram of the whole arrangement of an idling rotational speed control system for an internal combustion engine according to the invention.

Referring first to FIG. 1, there is illustrated the whole arrangement of an idling rotational speed control system for an internal combustion engine according to the invention. In the figure, reference numeral 1 designates a cylinder block of an internal combustion engine which may be a six-cylinder type, for example. Connected to the cylinder block 1 of the engine are an intake pipe (intake air passage) 3 provided with an air cleaner 2 at an open end thereof, and an exhaust pipe 4. Arranged in the intake pipe 3 is a throttle valve 5, which is bypassed by an auxiliary air passage 7 with one end 7*a* thereof opening into the interior of the intake pipe 3 at a downstream side of the throttle valve 5, and the other end communicating with the atmosphere by way of the air cleaner 2.

Arranged across the auxiliary air passage 7 is an auxiliary air control valve (hereinafter simply referred to as "the AIC control valve") 6. The AIC control valve 6 cooperates with an electronic control unit (hereinafter referred to as "the ECU") 8 to control the idling engine rotational speed of the engine. The opening of the valve (the opening area of the auxiliary air passage 7) is controlled by driving current (control signal) from the ECU 8. In this embodiment, as the AIC control valve 6, there is used a linear solenoid type electromagnetic valve which comprises a solenoid (valve driving means) 6*a* connected to the ECU 8 and a valve (control valve) 6*b* which opens the auxiliary air passage 7 by a degree (valve lift amount) proportional to the driving current $I_{CMD}$ when the solenoid 6*a* is energized.

Fuel injection valves 10, only one of which is shown, are mounted in the intake pipe 3 at locations between the cylinder block 1 of the engine and the open end 7*a* of the auxiliary air passage 7. The fuel injection valves 10 are connected to a fuel pump, not shown, and electrically connected to the ECU 8.

A throttle opening sensor ($\theta_{TH}$) 11 is connected to the throttle valve 5. An absolute pressure ($P_{BA}$) sensor 13 is provided in communication with the intake pipe 3 through a conduit 12 at a location downstream of the open end 7*a* of the auxiliary air passage 7. An engine coolant temperature ($T_W$) sensor 14 is mounted in the cylinder block 1 of the engine in a manner embedded in the peripheral wall of an engine cylinder having its interior filled with coolant. The sensors each are electrically connected to the ECU 8, and supply signals indicative of respective detected operating parameters of the engine to the ECU 8.

An engine rotational speed (Ne) sensor (hereinafter referred to as "the Ne sensor") 15 is arranged in facing relation to a camshaft of the engine or a crankshaft of same. The Ne sensor 15 generates a pulse (hereinafter referred to as "TDC signal pulse") at a predetermined crank angle position before a top dead center (TDC) at the start of suction stroke of each cylinder, whenever the engine crankshaft rotates through 120 degrees, and supplies the TDC signal pulse to the ECU 8.

Further, a starting switch 16 is connected to the ECU 8, and supplies a signal indicative of closed or open state thereof to the ECU 8.

Also connected to the ECU 8 are other sensors and switches 17, such as an atmospheric pressure sensor, a vehicle speed switch, a power steering switch, an air-conditioner (AC) switch, and other necessary switches, and signals therefrom are supplied to the ECU 8.

The auxiliary air passage 7 forms a bypass air passage which bypasses the throttle valve 5 in the intake passage 3, the AIC control valve 6 forms a control valve for adjusting the opening area of the bypass passage and valve driving means for driving the control valve. The ECU 8, which supplies a control signal (driving current) to the AIC control valve 6 for driving same, forms means for idling rotational speed control, i.e. after-start determining means for determining whether or not a first predetermined time period has elapsed after completion of cranking, desired engine rotational speed setting means for setting a desired engine rotational speed, difference determining means for determining a difference between a detected value of the engine rotational speed and a value of the desired engine rotational speed set by the desired engine rotational speed setting means, engine rotational speed variation detecting means for detecting a variation in the detected engine rotational speed, control amount determining means for determining a value of the control signal by the use of a proportional term and an integral term based on the determined difference, and a differential term based on the detected variation in the engine rotational speed, control gain determining means for determining control gains of the proportional, integral, and differential terms in response to the result of determination by the after-start determining means, and differential term changing means for setting and holding the differential term at zero before a second predetermined time period elapses after completion of cranking of the engine when the after-start determining means has detected that the first predetermined time period has not elapsed yet after completion of cranking of the engine.

The ECU 8 comprises an input circuit 8*a* having the functions of shaping the waveforms of input signals from various sensors and switches, shifting the voltage levels of sensor output signals to a predetermined level, converting analog signals from analog-output sensors to digital signals, and so forth, a central processing unit (hereinafter referred to as "the CPU") 8*b*, memory means 8*c* storing various operational programs which are executed in the CPU 8*b* and for storing results of calculations therefrom, etc., and an output circuit 8*d* which outputs driving signals to the fuel injection valves 10 and the AIC control valve 6. The ECU 8 operates in response to signals from the above-described various sensors etc. to determine operating conditions of the engine, calculate the valve opening period or fuel injection period over which the fuel injection valves 10 are to be opened in a conventional manner based upon the determined operating conditions, and the amount of auxiliary air or the valve opening command value $I_{CMD}$ (control amount) for the linear solenoid type AIC control valve 6 by a predetermined program described hereinafter, and supply driving signals in accordance with the calculated values to the fuel injection valves 10 and the control valve 6 by way of the output circuit 8*d*.

More specifically, the ECU 8 calculates the valve opening command value $I_{CMD}$ for the AIC control valve 6 by the use of the following equation (1):

$$I_{CMD}=(I_{FBn}+I_E+I_{PS}+I_{AT}+I_{AC})\times K_{PAD}+I_{PA} \quad (1)$$

where $I_{FBn}$ represents a feedback control value determined by a subroutine for determining the amount of auxiliary air, described hereinafter.

$I_E$ represents an electrical load-dependent correction value which is determined in accordance with the amount of electrical load on the battery, $I_{DS}$ a power steering-dependent correction value which is determined depending on whether the power steering switch is closed or open, $I_{AT}$ a gear position-dependent correction value which is determined depending on whether or not the shift lever of the automatic transmission is in a D range, and $I_{AC}$ an air-conditioner-dependent correction value which is determined depending on whether the air-conditioner switch is closed or open. These are external load-dependent correction values which are determined depending on external loads on the engine. Further, $K_{PAD}$ is an atmospheric pressure-dependent correction coefficient which is set to a greater value as the atmospheric pressure decreases to compensate for variation in the amount of air taken in through the AIC control valve 6, which takes place with decrease in the atmospheric pressure. $I_{PA}$ is an error correction coefficient for correcting variation in the intake air amount taken in through the intake air system other than the AIC control valve 6, such as the throttle valve 5 and a fast idle control valve, which takes place with change in the atmospheric pressure.

Thus, the ECU 8 sends out a driving signal based on the valve opening command value $I_{CMD}$ calculated as above to the AIC control valve 6, which in turn opens the auxiliary air passage 7 to a degree corresponding to the value $I_{CMD}$.

Next, the idling rotational speed control according to the invention will be described in detail with reference to FIGS. 2 to 6.

Figure 2:
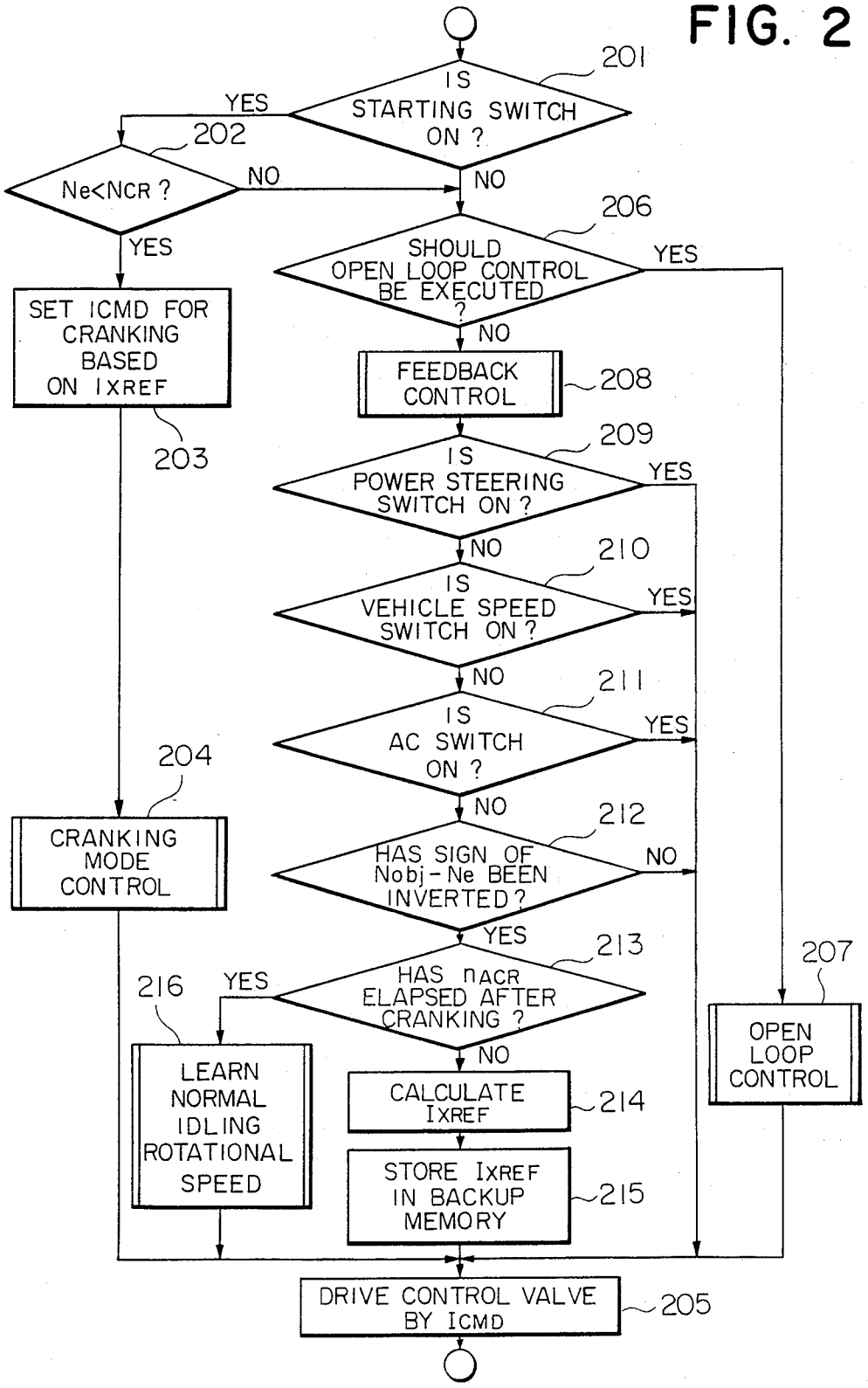
FIG. 2 is a flowchart of a main program for determining an intake air amount.

FIG. 2 shows a main program for determining the intake air amount (the valve opening command value $I_{CMD}$) by feedback control or open loop control responsive to engine operating conditions. This program is executed by the CPU 8*b* whenever a TDC signal pulse is generated.

First, at a step 201, it is determined whether or not the starting switch is on (closed). If the answer is affirmative (Yes), it is determined at a step 202 whether the engine is being cranked or at idle after completion of cranking, i.e. whether or not the engine rotational speed Ne is lower than a predetermined value $N_{CR}$. If the answer is affirmative (Yes), i.e. if the engine rotational speed Ne is lower than the value $N_{CR}$ (the engine is being cranked), control current for the solenoid 6*a* which is to be applied during cranking of the engine, i.e. the valve opening command value $I_{CMD}$ is set at a step 203.

The value $I_{CMD}$ is calculated based on a learned value $I_{XREF}$ read from a backup memory of the memory means 8*c* by the following equation:

$$I_{CMD}=((I_{XREF}+I_{UP})+I_E+I_{PS}+I_{AT}+I_{AC})\times K_{PAD}+I_{PA} \quad (2)$$

where $I_{UP}$ represents a correction value added to $I_{XREF(I)}$, which is experimentally determined.

Not only a value of the $I_{CMD}$ to be applied during cranking of the engine but also an initial value of the $I_{CMD}$ to be applied immediately after transition to idling of the engine, referred to hereinafter, are set based upon the learned value read from the backup memory. Therefore, it is possible to reduce a width of change in the value $I_{CMD}$ which occurs upon transition of the engine operating condition from cranking to idling, to thereby improve the stability of the rotational speed of the engine. Further, a proper value of the $I_{XREF}$ is calculated and stored in the thus stabilized state of the engine rotational speed Ne (see the Ne characteristics indicated by the solid line in FIG. 5), and applied at the step 203, so that the control current during cranking, and hence the engine rotational speed Ne, is further stabilized.

Then, at the following step 204, the control is carried out in cranking mode, and the AIC control valve 6 is driven by a driving signal based on the thus calculated valve opening command valve $I_{CMD}$ during cranking (step 205), followed by terminating the present program.

If the answer to the question of the step 201 is negative (No), i.e. if it is determined that the starting switch 16 is not on, or if the answer to the question of the step 202 is negative (No), i.e. if it is determined that the condition $Ne \geqq N_{CR}$ is satisfied, it is judged that the engine has left the cranking condition, and the program proceeds to steps 206 et seq.

At the step 206 it is determined whether or not the engine is in an operating condition in which the idling engine rotational speed should be controlled by the open loop control. This determination can be carried out by a predetermined determinating subroutine, not shown. If the answer to the question of the step 206 is affirmative (Yes), the valve opening command value $I_{CMD}$ for the AIC control valve 6 is determined by the open loop control at a step 207, and then the step 205 is executed, followed by terminating the present program. On the other hand, if the answer is negative (No), i.e. if it is determined that the feedback control should be carried out, the program proceeds to steps 208 et seq. In the case where the present loop is one immediately after completion of cranking, the program proceeds from the step 206 to the step 208, where, as described in derail hereinafter, the valve opening command value $I_{CMD}$ is determined by a feedback control subroutine including a step of inhibiting the application to the differential term (D term) before the elapse of a predetermined time period after completion of cranking. Then, the program proceeds to steps 209 et seq. to execute learning control, and then the step 205 is executed, followed by terminating the present program. Namely, the driving signal based on the valve opening command value $I_{CMD}$ determined at the step 208 is sent from the output circuit 8*d* of the ECU 8 to the AIC control valve 6.

The feedback control carried out at the step 208 for determining the valve opening command value $I_{CMD}$ will be described below with reference to FIG. 3. The feedback control in this embodiment is carried out by determining the feedback control value $I_{FBn}$ of the aforesaid equation (1) by the subroutine for determining the amount of auxiliary air described below in detail.

Figure 3:
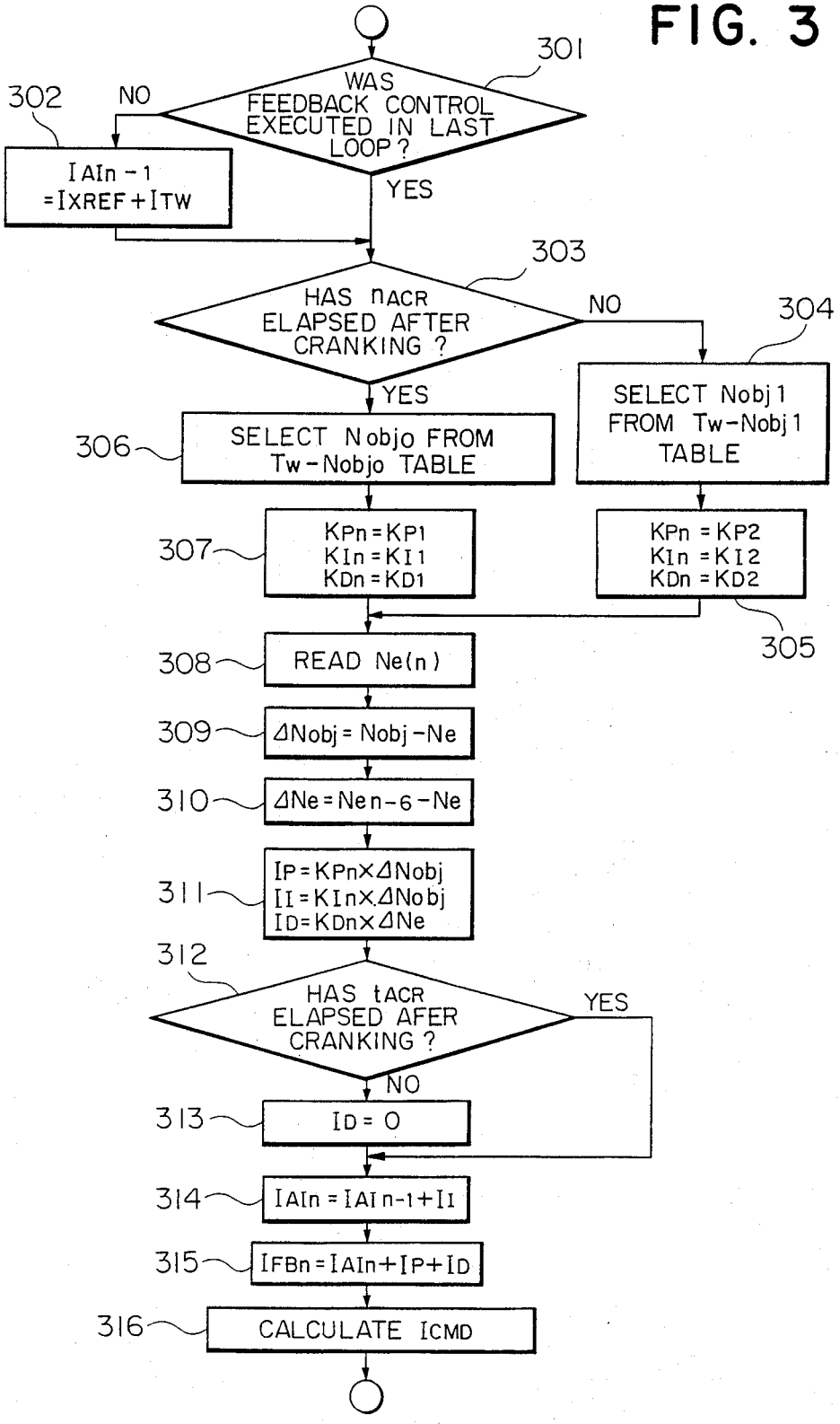
FIG. 3 is a flowchart of a subroutine for determining an amount of auxiliary air in which a feedback control value $I_{FBn}$ is determined.

Referring to FIG. 3, at a step 301, it is determined whether an integral term $I_{AIn-1}$ of the feedback control value $I_{FBn}$ to be calculated at a step 314, referred to hereinafter, should be initialized in the present loop. In other words, it is determined at the step 301 whether or not the feedback control was executed in the immediately preceding loop.

If the answer to the question of the step 301 is negative (No), i.e. if the present loop is the first loop immediately after transition of the engine operating condition from the open loop control condition to the feedback control condition, the integral term $I_{AIn-1}$ is initialized at the following step 302 in a manner described below, and then the program proceeds to steps 303 et seq. On the other hand, if the answer to the question of the step 301 is affirmative (Yes), i.e. if the present loop is not the first loop after transition of the engine operating condition to the feedback control condition, the program proceeds to the step 303 without initializing the integral term $I_{AIn-1}$.

Since the present loop is the first loop after transition from the cranking mode, in which the open loop control is carried out, to the idling mode, the program proceeds through the step 302, where the initialization of the integral term $I_{AIn-1}$ is carried out, to the step 303.

The initialization of the integral term $I_{AIn-1}$ at the step 302 is carried out by adding a coolant temperature-dependent correction value $I_{TW}$ set in accordance with the engine coolant temperature $T_W$ to $I_{XREF}$, i.e. a learned value (e.g. an average value) of the integral term $I_{AIn}$ which is obtained, as described hereinafter, when predetermined conditions are satisfied. The coolant temperature-dependent correction value $I_{TW}$ is set such that values $I_{TW1}$ to $I_{TWm}$ correspond, respectively, to engine coolant temperature values $T_{W1}$ to $T_{Wm}$. In general, the value $I_{TW}$ decreases with rise in the engine coolant temperature $T_W$.

Figure 5:
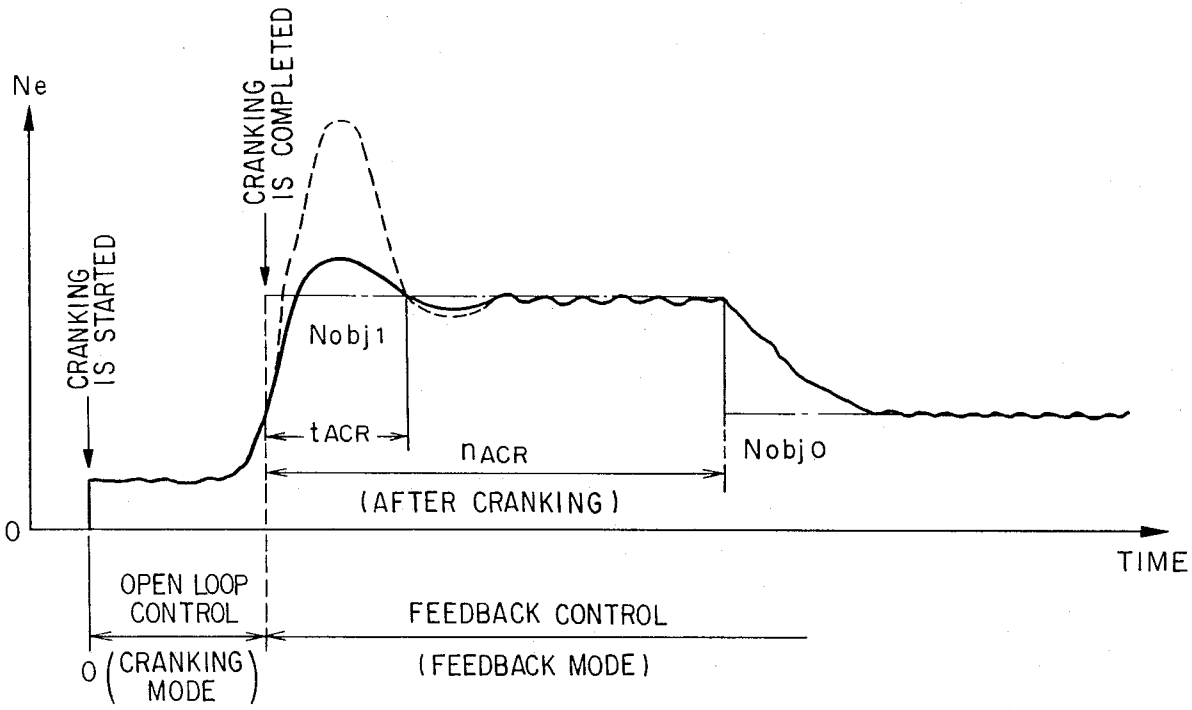
FIG. 5 is a diagram useful in explaining changes relative to time of the engine rotational speed during cranking and after completion of cranking.
Figure 6:
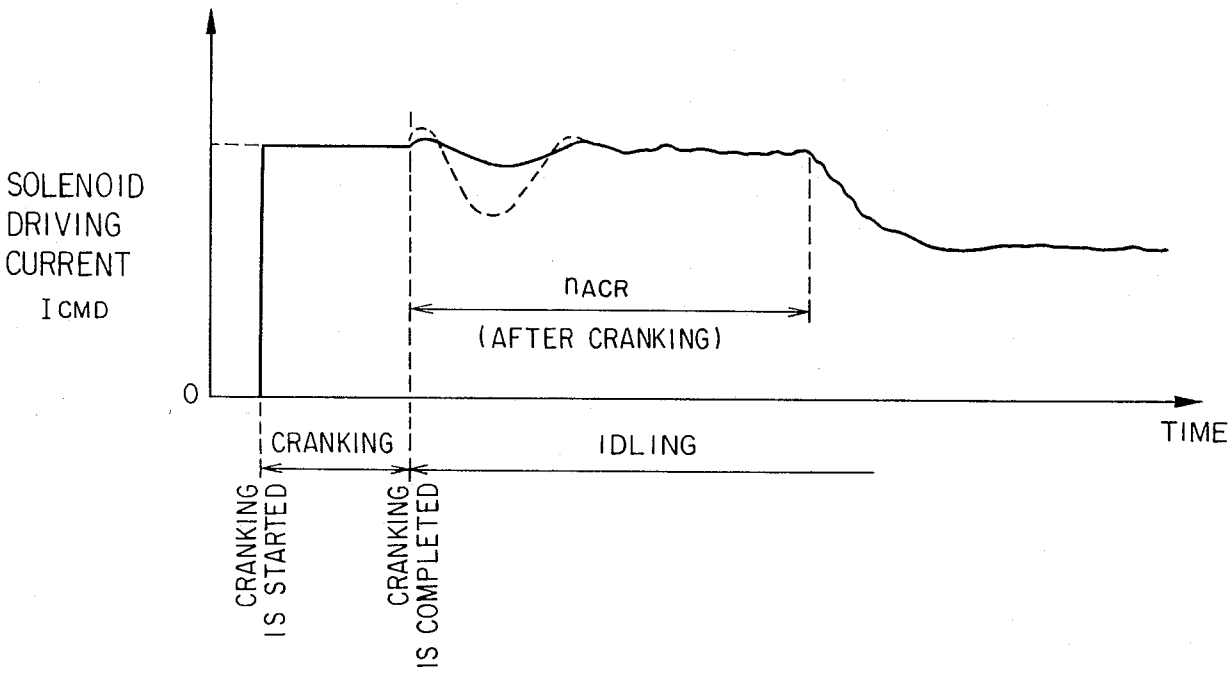
FIG. 6 is a diagram useful in explaining changes relative to time of a valve opening command value $I_{CMD}$ for an auxiliary air control valve during cranking and after completion of cranking.

At the step 303, it is determined whether or not the number of TDC signal pulses counted after completion of cranking exceeds a predetermined number $\eta_{ACR}$, i.e. whether or not a first predetermined time period has elapsed after completion of cranking (see FIGS. 5 and 6).

If the answer to the question of the step 303 is negative (No), i.e. if the number of TDC signal pulses counted after completion of cranking does not exceed the predetermined number $\eta_{ACR}$, the setting of a desired idling engine rotational speed $N_{obj}$, and determination of a control gain, which determines the feedback gain, are carried out at steps 304 and 305.

More specifically, at the step 304, a higher desired engine rotational speed is set as the desired idling engine rotational speed $N_{obj}$, i.e. the higher desired engine rotational speed $N_{obj1}$ is selected from a $T_W$-$N_{obj1}$ table of a $T_W$-$N_{obj}$ table in accordance with a value of the engine coolant temperature $T_W$ detected at that time.

Figure 4:
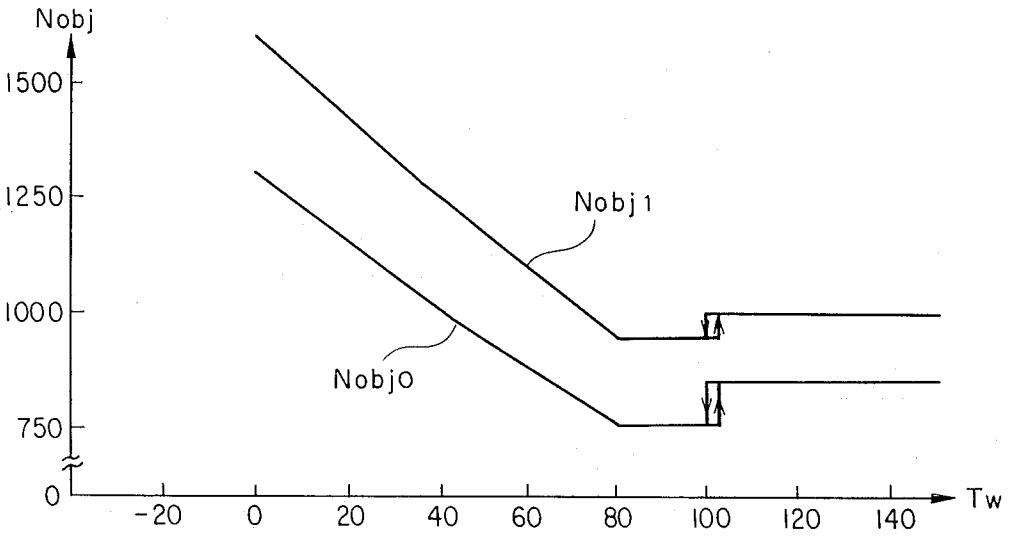
FIG. 4 is a diagram showing an example of a $T_W$--$N_{obj}$ table.

FIG. 4 shows an example of the $T_W$-$N_{obj}$ table. The values $N_{obj}$ as a function of the $T_W$ are stored in the memory means 8c.

The higher desired engine rotational speed $N_{obj1}$ is applied during a time period immediately after the start of self-sustaining of the engine until counting-up of the predetermined number $\eta_{ACR}$ of TDC signal pulses, in order to improve the combustion of the engine immediately after completion of cranking. In the meanwhile, a lower desired engine engine rotational speed $N_{obj0}$ is applied after it is determined that the number of TDC signal pulses counted after completion of cranking exceeds the predetermined number $\eta_{ACR}$. That is, the value $N_{obj0}$ is applied to the idling feedback control under the normal operating conditions of the engine, and selected at the step 306, referred to hereinafter.

At the step 305, a coefficient $K_{Pn}$ for determining a proportional term control gain, a coefficient $K_{In}$ for determining an integral term control gain, and a coefficient $K_{Dn}$ for determining a differential term control gain are set to predetermined values $K_{P2}$, $K_{I2}$, and $K_{D2}$ respectively. In the memory means 8c, there are stored the predetermined value $K_{P2}$ and a predetermined value $K_{P1}$ ($K_{P1}>K_{P2}$) selected at a step 307, referred to hereinafter, as $K_{Pn}$, the predetermined value $K_{I2}$ and a predetermined value $K_{I1}$ ($K_{I1}>K_{I2}$) selected at the step 307 as $K_{In}$, and the predetermined value $K_{D2}$ and a predetermined value $K_{D1}$ ($K_{D1}>K_{D2}$) selected at the step 307 as $K_{Dn}$. Following the step 305, the program proceeds to a step 308.

As described above, as each of the control gains, two kinds of values are selected. Lower control gains are selected during a time period after completion of cranking and before counting-up of the predetermined number $\eta_{ACR}$ of TDC signal pulses, i.e. while the combustion of the engine is unstable, to thereby prevent hunting or fluctuation of the engine rotational speed Ne. Further, the differential term is inhibited from being applied during a predetermined time period (a second predetermined time period $t_{ACR}$) to there by further stabilize the engine rotational speed Ne as hereinafter described.

More specifically, at the step 308, the actual engine rotational speed detected by the Ne sensor 15 is read, and then at steps 309 and 310, calculated are a difference $\Delta N_{obj}$ between the desired idling engine rotational speed $N_{obj}$ and the actual engine rotational speed Ne, and a difference $\Delta Ne$ between the engine rotational speed $Ne_{n-6}$ detected 6 TDC signal pulses earlier and the actual engine rotational speed Ne detected in the present loop, i.e. a variation in the engine rotational speed.

Then, at the following step 311, calculated in accordance with the difference $\Delta N_{obj}$ and the variation $\Delta Ne$ calculated at the steps 309 and 310 are a proportional term $I_P$ and a differential term $I_D$ used for calculation of the feedback control value $I_{FBn}$, and a correction term $I_I$ for correcting the integral term $I_{AIn}$. More specifically, the proportional term $I_P$ is obtained by multiplying the difference $\Delta N_{obj}$ by the coefficient $K_{Pn}$, the differential term $I_D$ by multiplying the variation $\Delta Ne$ by the coefficient $K_{Dn}$, and the correction term $I_I$ by multiplying the difference $\Delta N_{obj}$ by the coefficient $K_{In}$, respectively.

However, the differential term $I_D$ calculated at the step 311 is not unconditionally used in the calculation of the feedback control value $I_{FBn}$. If the second predetermined time period $t_{ACR}$ has not elapsed after completion of cranking, the differential term $I_D$ is set to 0. More specifically, at the following step 312, it is determined whether or not the second predetermined time period $t_{ACR}$ (e.g. 2 seconds) has elapsed after completion of cranking. The second predetermined time period $t_{ACR}$ is set such that it corresponds to a time period during which the engine rotational speed tends to sharply rise and fall as indicated by the broken line in FIG. 5. More preferably, as shown in FIG. 5, the $t_{ACR}$ is set such that it corresponds to a time period from the time point of completion of cranking to the time point at which the broken line indicative of the engine rotational speed characteristic crosses the one dot chain line indicative of the desired engine rotational speed $N_{obj1}$ for the first time when the engine rotational speed falls. The thus set $t_{ACR}$ is more effective.

In this embodiment, the second predetermined time period $t_{ACR}$ is shorter than the first predetermined time period defined by the predetermined number $\eta_{ACR}$ of TDC signal pulses. However, these predetermined time periods may be equal to each other. The first predetermined time period may be measured by a timer instead of counting $\eta_{ACR}$. The second predetermined time period may be measured by a timer. However, this is not limitative, and the lapse of the second predetermined time period may be determined by counting TDC signal pulses. If the answer to the question of the step 312 is negative (No), i.e. if the second predetermined time period $t_{ACR}$ has not elapsed yet, the differential term $I_D$ calculated at the step 311 is reset to 0 at a step 313, and then steps 314 et seq. are carried out. On the other hand, after the lapse of the second predetermined time period $t_{ACR}$, i.e. if the answer to the question of the step 312 is affirmative (Yes), the program skips over the step 313 to the steps 314 et seq. In other words, upon the lapse of the time period $t_{ACR}$, the inhibition of application of the differential term $I_D$ is cancelled.

As a result, as shown in FIGS. 5 and 6, the drop in the control amount after cranking and the rapid rise and fall of the engine rotational speed Ne as indicated by the broken lines are prevented to thereby carry out stable idling rotational speed control as indicated by the solid lines.

As described hereinabove, the differential term $I_D$ is calculated by multiplying the coefficient $K_{Dn}$ by the difference $\Delta Ne$ (the difference between a rotational speed Ne detected for a particular cylinder a predetermined number of TDC signal pulses earlier ($Ne_{n-6}$ in the case of a 6-cylinder type engine) and a rotational speed Ne actually detected for the same cylinder in the present loop, i.e. variation of Ne per engine cycle). As shown in FIG. 5, the aforedescribed phenomenon is conspicuous when the rise and fall of the engine rotational speed Ne are steep immediately after transition of the engine operating condition from cranking to idling. In other words, if the differential term $I_D$ is applied to the feedback control on such an occasion, the differential term is more influential than the proportional and integral terms, and the engine rotational speed is most greatly affected by differential term in response to rise and fall of the engine rotational speed Ne (the more steeply the rotational speed Ne rises or falls, the more steeply the differential term acts to change the rotational speed.)

Therefore, according to the invention, when the feedback control value $I_{FBn}$ is calculated, the differential term is cancelled (i.e. set to 0) under the condition that the present loop is within the predetermined time period after completion of cranking to prevent fluctuation of the rotational speed Ne at the early stage of the feedback control after completion of cranking.

At the following step 314, the integral term $I_{AIn}$ in the present loop is calculated by adding the correction value $I_I$ obtained at the step 311 to the value $I_{AIn-1}$ (the value initialized at the step 302 or the value obtained in the immediately preceding loop after initialization). Then at a step 315, the feedback control value $I_{FBn}$ in the present loop is calculated by adding the proportional term $I_P$ and the differential term $I_D$ ($I_D=0$ before the lapse of the time period $t_{ACR}$) to the integral term $I_{AIn}$ obtained at the step 314. At the following step 316, the valve opening command value $I_{CMD}$ is calculated in accordance with the equation (1) by the use of the $I_{FBn}$ calculated at the step 315, followed by terminating the present subroutine.

If the answer to the question of the step 303 is Yes, i.e. if it is determined that the number of TDC signal pulses counted after completion of cranking exceeds the predetermined number $\eta_{ACR}$, a value of the lower desired engine rotational speed $N_{obj0}$, referred to hereinabove, is selected at the step 306 from the $T_W$–$N_{obj0}$ table as the desired idling engine rotational speed $N_{obj}$ in accordance with the engine coolant temperature $T_W$ detected at that time. Then, at the following step 307, as the coefficients $K_{Pn}$, $K_{In}$, and $K_{Dn}$, the aforesaid predetermined values $K_{P1}$, $K_{I1}$, and $K_{D1}$ are selected, followed by executing the above-described steps 308 to 311. Then, the program proceeds to the step 312.

In this case, the answer to the question of the step 312 is affirmative (Yes) (the inhibition of application of the differential term $I_D$ has already been cancelled before this time point), so that the step 313 is skipped over. At the following steps 314 to 316, the command value $I_{CMD}$ is calculated by the use of the calculated differential term $I_D$, followed by terminating the present subroutine.

Thus, after completion of cranking, the valve opening command value $I_{CMD}$ and the engine rotational speed Ne undergo changes as indicated by the solid lines in FIGS. 5 and 6, while the learning control is carried out under predetermined conditions.

More specifically, referring again to FIG. 2, the program proceeds from the step 208 to steps 209 et seq. First, at steps 209 to 211, it is determined whether or not load is applied on the engine or the battery.

Specifically, at the step 209, it is determined whether or not the power steering switch is on, at the step 210 whether or not the vehicle speed switch is on (i e. whether or not the vehicle speed exceeds a predetermined value), and at the step 211, whether or not the AC switch is on, respectively.

If any of the answers to the questions of the steps 209 to 211 is affirmative (Yes). i.e if the engine or the battery is under load, the aforesaid step 205 is immediately executed, followed by terminating the present program. If all the answers are negative (No), i.e. if no load is applied on the engine or the battery, the program proceeds to steps 212 et seq.

At the step 212, the difference between the desired idling engine rotational speed $N_{obj}$ and the actual engine rotational speed Ne is calculated, and it is determined whether or not the sign of the difference has been inverted from plus to minus, or vice versa, between the immediately preceding loop and the present loop.

In other words, it is determined whether or not the curve of the engine rotational speed Ne as indicated by the solid line in FIG. 5 has crossed the one dot chain line of the desired engine rotational speed $N_{obj}$ shown in same. If the answer to this question is negative (No), the step 205 is executed, followed by terminating the present program. On the other hand, if the answer to the question of the step 212 is affirmative (Yes), it is determined at a step 213 whether or not the number of TDC signal pulses counted after completion of cranking exceeds the predetermined number $\eta_{ACR}$. If the answer to the question of the step 213 is negative (No), i.e. if the number of TDC signal pulses counted after completion of cranking does not exceed the predetermined number $\eta_{ACR}$, therefore, if the higher desired engine rotational speed $N_{obj1}$ has been selected as the desired speed $N_{obj}$ as described with reference to the step 304 in FIG. 3, the learned value $I_{XREF}$ is calculated at a step 214.

The learned value $I_{XREF}$, which is used as a basic value for determining an initial value of the control current for the solenoid 6a, is calculated depending on one of a plurality of predetermined temperature ranges within which the actual engine coolant temperature $T_W$ falls, bY the following equation (3):

$$I_{XREF}=I_{AIn}\times(C_{XREF}/A)+I_{XREFn-1}\times(A-C_{XREF})/A \quad (3)$$

where $I_{AIn}$ represents a value calculated at the step 314 in FIG. 3, i.e. a value of the integral term in the present loop, A constant, $C_{XREF}$ a variable which is experimentally set to a suitable value (e.g. 256 or less) seleoted from a range of 1 to A, and $I_{XREFn-1}$ an average value of the $I_{AIn}$ values obtained up to the immediately preceding loop in an engine coolant temperature range within which the actual engine coolant temperature of the present loop falls.

Thus, the calculated values of the learned value $I_{XREF}$ are classified and stored in accordance with their temperature ranges. More specifically, at the step 215, a calculated value of the $I_{XREF}$ is stored into a map provided in the backup memory within the memory means 8c, and then the step 205 is executed, followed by terminating the present program.

If the answer to the question of the step 213 is affirmative (Yes), i.e. if the number of TDC signal pulses counted after completion of cranking exceeds the predetermined number $\eta_{ACR}$, and therefore the lower desired engine rotational speed $N_{obj0}$ has been selected as the desired speed $N_{obj}$, ordinary learning of the idling rotational speed is carried out at a step 218, and then the step 205 is executed, followed by terminating the present program.

Thus, the learning control is carried out, and one of the values learned as $I_{XREF}$ is read from the backup memory when the engine is started on the next occasion, and used for determining the command value $I_{CMD}$ during cranking as well as an initial value of $I_{AIn}$ after completion of cranking.

As described above, the system according to the invention is equipped with differential term changing means for changing the differential term $I_D$ for determining the feedback control gain to 0 during the second predetermined time period when it is determined that the present loop is within the first predetermined time period after completion of cranking. Therefore, it is possible to positively avoid a drop in the control amount used for the control valve and a rapid rise and fall of the engine rotational speed upon transition of the engine operating condition from cranking to idling, to thereby prevent fluctuation of the engine rotational speed immediately after completion of cranking so that the engine rotational speed can be further stabilized.

What is claimed is:

1. In a system for controlling an idling rotational speed of an internal combustion engine having an intake air passage, and a throttle valve provided in said intake air passage, said system including a bypass air passage bypassing said throttle valve, a control valve for adjusting opening area of said bypass air passage, valve driving means for driving said control valve, and control means for supplying a control signal to said valve driving means, said control means including engine rotational speed detecting means for detecting a rotational speed of said engine, after-start determining means for determining whether or not a first predetermined time period has elapsed after completion of cranking of said engine, desired engine rotational speed setting means for setting a desired idling rotational speed of said engine, difference determining means for determining a difference between the engine rotational speed detected by said engine rotational speed detecting means and the desired idling engine rotational speed set by said desired engine rotational speed setting means, engine rotational speed variation detecting means for detecting a variation in the detected engine rotational speed, control amount determining means for determining a value of the control signal by the use of at least one control term based on the determined difference and a differential term based on the detected engine rotational speed variation, control gain determining means for determining control gains of said at least one control term and said differential term in response to the result of determination by said after-start determining means, the improvement comprising differential term changing means for setting and holding the differential term at zero before a second predetermined time period elapses after completion of cranking of said engine when said after-start determining means has detected that the first predetermined time period has not elapsed yet after completion of cranking of said engine.

2. A system according to claim 1, wherein the second predetermined time period is shorter than the first predetermined time period.

3. A system according to claim 1, wherein the second predetermined time period is equal to the first predetermined time period.

4. A system according to claim 1, wherein the second predetermined time period corresponds to a time period after completion of cranking of said engine during which the variation in the engine rotational speed is great.

5. A system according to claim 1, wherein the second predetermined time period is a time period during which a predetermined number of pulses are generated, each of said pulses being generated whenever the engine rotates through a predetermined angle after completion of cranking of said engine.

6. A system according to claim 1, wherein said desired engine rotational speed setting means sets the desired idling engine rotational speed to a higher predetermined value before the first predetermined time period elapses after completion of cranking of said engine, whereas said desired engine rotational speed setting means sets the desired idling engine rotational speed to a lower predetermined value after the first predetermined time period has elapsed.

7. A system according to claim 6, wherein said control gain determining means sets the at least one control term and the differential term to values enabling to obtain greater control gains in order to attain the desired idling engine rotational speed set to the higher predetermined value before the first predetermined time period elapses after completion of cranking of said engine, whereas said control gain determining means sets the at least one control term and the differential term to values enabling to obtain smaller control gains in order to attain the desired idling engine rotational speed set to the lower predetermined value after the first predetermined time period has elapsed after completion of cranking of said engine.

8. A system according to claim 1, wherein the at least one control term comprises a proportional term, and an integral term.

* * * * *